US005119883A

United States Patent [19]

Wagstaff et al.

[11] Patent Number: 5,119,883

[45] Date of Patent: Jun. 9, 1992

[54] APPARATUS AND PROCESS FOR DIRECT COOLING AN EMERGING INGOT WITH GAS-LADEN COOLANT

[75] Inventors: Frank E. Wagstaff; Robert B. Wagstaff, both of Veradale; Hans Fischer, Mead, all of Wash.

[73] Assignee: Wagstaff Engineering Incorporated, Spokane, Wash.

[21] Appl. No.: 744,997

[22] Filed: Aug. 14, 1991

Related U.S. Application Data

[63] Continuation-in-part of Ser. No. 393,448, Aug. 14, 1989, Pat. No. 5,040,595.

[51] Int. Cl.[5] ..... B22D 11/04; B22D 11/124

[52] U.S. Cl. ..... 164/487; 164/444

[58] Field of Search ..... 164/487, 486, 444, 415

[56] References Cited

U.S. PATENT DOCUMENTS

| | | | |
|---|---|---|---|
| 3,713,479 | 1/1973 | Bryson | 164/487 |
| 4,166,495 | 9/1979 | Yu | 164/486 |
| 4,200,138 | 4/1980 | Hildebrandt | 164/415 X |
| 4,597,432 | 7/1986 | Collins et al. | 164/487 X |
| 4,598,763 | 7/1986 | Wagstaff et al. | 164/487 X |
| 4,693,298 | 9/1987 | Wagstaff | 164/486 |
| 4,732,209 | 3/1988 | Apostolov et al. | 164/444 X |

*Primary Examiner*—J. Reed Batten, Jr.

*Attorney, Agent, or Firm*—Christopher Duffy

[57] ABSTRACT

A body of partially solidified metal emerging as ingot from the exit end 10 of an open ended mold 2, is direct cooled by charging liquid coolant into an annular retention chamber 32 circumposed about the exit end opening of the mold in the body thereof, and discharging the coolant from the chamber onto the surface of the ingot through a first passage 14 opening into the exit end of the mold and communicating with the chamber at an opening 50 therein. At times, such as in the butt-forming stage, a second passage 46 is formed in the chamber which is serially interconnected with the first passage 14 at the chamber opening 50 and operable to deliver the chamber coolant to the first passage at an increased rate of flow, relative to the rate at which the coolant was charged into the chamber. Pressurized gas is forced into the coolant flow through a body 72 of solid but porous, gas-permeable material that is incorporated into the wall 60 of the second passage at a surface thereof which extends generally parallel to the flow of coolant in the second passage. In this way, the coolant is amended to discharge through the first passage 14 in a discontinuous liquid phase in which it is laden with bubbles of undissolved gas that will alter the heat transfer characteristics of the coolant on the surface of the ingot to vary the rate at which heat is lost therefrom.

53 Claims, 3 Drawing Sheets

APPARATUS AND PROCESS FOR DIRECT COOLING AN EMERGING INGOT WITH GAS-LADEN COOLANT

CROSS-REFERENCE TO RELATED APPLICATION

This application is a continuation-in-part of application Ser. No. 393,448 filed Aug. 14, 1989 and now U.S. Pat. No. 5,040,595.

TECHNICAL FIELD

This invention relates to a means and technique for direct cooling a body of partially solidified metal emerging as ingot from the exit end of an open ended mold by the steps of discharging liquid coolant onto the surface of the ingot through a passage of the mold which opens into the exit end of the mold at an aperture therein, and when desired, such as in the formation of the butt of the ingot, infusing the coolant with gas so that when the coolant discharges from the aperture, it is laden with gas which alters its heat transfer characteristics on the surface of the ingot and reduces the rate at which the coolant extracts heat from the ingot. More particularly, the invention relates to a means and technique of this nature wherein the coolant is infused with gas at a point ahead of the passage, and at a pressure of less than that which is needed to dissolve the gas in the coolant, so that the coolant discharges through the passage in a discontinuous liquid phase in which it is laden with bubbles of undissolved gas that will have the aforementioned effect when the coolant reaches the surface of the ingot.

BACKGROUND ART

In the earlier application, the coolant was infused with bubbles in the passage itself, at a surface of the wall of the passage which extended generally parallel to the flow of the coolant in the passage and coterminated with the exit end of the mold at the aperture to form an edge thereof. Moreover, as explained in the earlier application, the coolant was preferably infused with bubbles from a body of solid, but porous, gas-permeable material which extended in a continuous band around the wall of the passage, so as to maximize the area over which the gas was infused into the coolant flow. That is, it had been observed that the greater the area over which the bubbles were nucleated into the coolant, the finer the bubbles that were entrained in the flow, and the finer the bubbles, the less the tendency of the bubbles to coalesce and produce a massive rush of bubbles or "blow-out." Now, it has been observed still further that when finer bubbles are generated, such as from a continuous band, the coolant actually can be infused with bubbles at a much earlier location than in the passage itself, such as in an annular retention chamber that is circumposed about the exit end opening of the mold in the body thereof, and operable to charge the passage with the coolant that is discharged onto the surface of the ingot from the passage. This earlier location has the distinct advantage that even when the passage is in the form of a series of spaced holes that are arranged in an annulus around the exit end opening of the mold, the body of the porous material can still take the form of a continuous band of the same, if desired, because the body of material is disposed ahead of the holes, i.e., in such a retention chamber.

SUMMARY OF THE INVENTION

As before, the coolant is charged into an annular retention chamber circumposed about the exit end opening of the mold in the body thereof, and then discharged from the chamber onto the surface of the ingot through a passage opening into the exit end of the mold and communicating with the chamber at a opening therein. Now, however, in addition to that first passage, a second passage is formed in the chamber which is serially interconnected with the first passage at the chamber opening and operable to deliver the chamber coolant to the first passage at an increased rate of flow, relative to the rate at which the coolant was charged into the chamber. Moreover, the body of solid but porous, gas-permeable material is incorporated into the wall of the second passage at a surface thereof which extends generally parallel to the flow of coolant in the second passage, and pressurized gas is forced through the body of porous, gas-permeable material at a pressure which is less than that which is needed to dissolve the gas in the coolant, so that the chamber coolant discharges through the first passage in a discontinuous liquid phase in which it is laden with bubbles of undissolved gas that will alter the heat transfer characteristics of the coolant on the surface of the ingot to vary the rate at which heat is lost therefrom.

There are many ways to practice the invention, but by way of example, in certain of the presently preferred embodiments of the invention, the respective passages define flow paths that extend generally parallel to that axis of the mold extending between the end openings thereof. In some, for example, the first passage communicates with the chamber at an opening in the inner peripheral wall thereof, the flow paths of the respective passages are disposed on opposite sides of the chamber opening, and the flow in the same is directed unidirectionally of the mold axis, but undergoes a dog-leg at the chamber opening. In others, the first passage once again communicates with the chamber at an opening in the inner peripheral wall thereof, but the flow paths of the respective passages are disposed on the same side of the chamber opening, and the flow in the same is directed in the opposing directions of the mold axis, but undergoes a reentrant turn at the chamber opening. In each set of embodiments, a baffling medium may be formed on the downstream side of the chamber opening to aid the coolant in traversing the dog-leg or the reentrant turn.

To illustrate, in many of the presently preferred embodiments of the invention, the second passage is formed by installing a baffle in the chamber to subdivide the chamber into two portions, one of which is serially interconnected with and between the remaining portion and the first passage at an opening defined by the baffle, and the chamber opening, respectively. In some, for example, the baffle is annular and installed in the chamber so as to subdivide the chamber into relatively inner and outer peripheral portions, the coolant is charged into the outer peripheral portion of the chamber, and the first passage communicates with the chamber at an opening in the inner peripheral portion thereof. The opening defined by the baffle is spaced apart from the chamber opening lengthwise of that axis of the mold extending between the end openings thereof, and the inner peripheral portion of the chamber is reduced in width relative to the outer peripheral portion thereof, radially of the axis, so that the chamber coolant is delivered to the first passage at an increased rate of flow, relative to the rate at which the coolant was charged into the outer peripheral portion of the chamber. Meanwhile, the body of porous, gas-permeable material is substantially annular and incorporated into the inner peripheral wall of the baffle at that surface of the baffle wall which extends between the chamber opening and the opening defined by the baffle.

In certain of the foregoing embodiments, the first passage communicates with the chamber at an opening in the inner peripheral wall thereof, the baffle has an opening in the body thereof, and the body of porous, gas-permeable material is recessed in a groove substantially circumscribed about the inner peripheral portion of the chamber in the inner peripheral wall of the baffle at that surface of the baffle wall extending between the respective openings of the baffle and the inner peripheral wall of the chamber. Often, the baffle is also equipped with an annular rib on the downstream side of the opening in the inner peripheral wall of the chamber to aid the coolant in traversing the chamber opening.

As indicated earlier, one advantage of the invention is the fact that the first passage may take the form of a series of spaced holes that are arrayed in an annulus about the exit end opening of the mold. Preferably, the holes communicate with the chamber at a circumferential groove in the inner peripheral wall of the chamber.

Once again, the porous, gas-permeable material is a sintered particle material, but in accordance with the present invention, the sintered particle material preferably comprises sintered plastic particles.

As seen, in constructing the mold, means are installed in the chamber to form the second passage therein, the body of porous, gas-permeable material is incorporated into the wall of the second passage, and means are provided for forcing pressurized gas through that body to achieve the desired result. Moreover, as indicated, the passage forming means may include a baffle which subdivides the chamber into two portions, such as relatively inner and outer portions, and the body of porous, gas-permeable material may be substantially annular and incorporated into the inner peripheral wall of the baffle. The means for forcing pressurized gas through the body of porous material, on the other hand, may be connected to the outer peripheral wall of the baffle opposite the body of porous material.

In one particularly advantageous arrangement, the mold comprises an annular case having an annular groove in the exit end thereof, and the baffle is installed in the chamber by securing an annular plate to the exit end of the case which covers the groove to form the chamber, and has the baffle relatively upstanding thereon to subdivide the chamber into relatively inner and outer peripheral portions. For example, in certain of the presently preferred embodiments of the invention, the first passage communicates with the chamber at an opening in the inner peripheral wall thereof, the baffle has an opening in the body thereof which is operatively spaced apart from the chamber opening lengthwise of that axis of the mold extending between the end openings thereof, the body of porous, gas-permeable material is substantially annular and incorporated into the inner peripheral wall of the baffle at that surface of the baffle wall operatively disposed to extend between the chamber opening and the opening in the baffle, and the means for forcing pressurized gas through the body of porous material are supported on the plate to occupy the outer peripheral portion of the chamber in connection with the outer peripheral wall of the baffle at an inlet opposite the body of porous material. Sometimes, among these embodiments, the body of porous material is recessed in a groove operatively substantially circumscribed about the inner peripheral portion of the chamber in the inner peripheral wall of the baffle, and the gas pressurization means are interconnected with a channel that is circumscribed about the body of porous material at the bottom of the groove in the baffle to supply the gas to the same throughout the circumference of the body of porous material. Furthermore, the gas pressurization means include a system of piping which is supported on the plate and installed in the outer peripheral portion of the chamber when the plate is secured to the case, to feed the gas to the channel through a set of inlets on the outer peripheral wall of the baffle opposite the channel. In fact, because of these features, the baffle itself is a construction component of the invention, as is the annular plate having the baffle relatively upstanding thereon.

BRIEF DESCRIPTION OF THE DRAWINGS

These features will be better understood by reference to the accompanying drawings wherein several of the presently preferred embodiments of the mold, the mold components, and the processes of making and using the mold, are illustrated.

In the drawings.

BEST MODE FOR CARRYING OUT THE INVENTION

Figure 1:
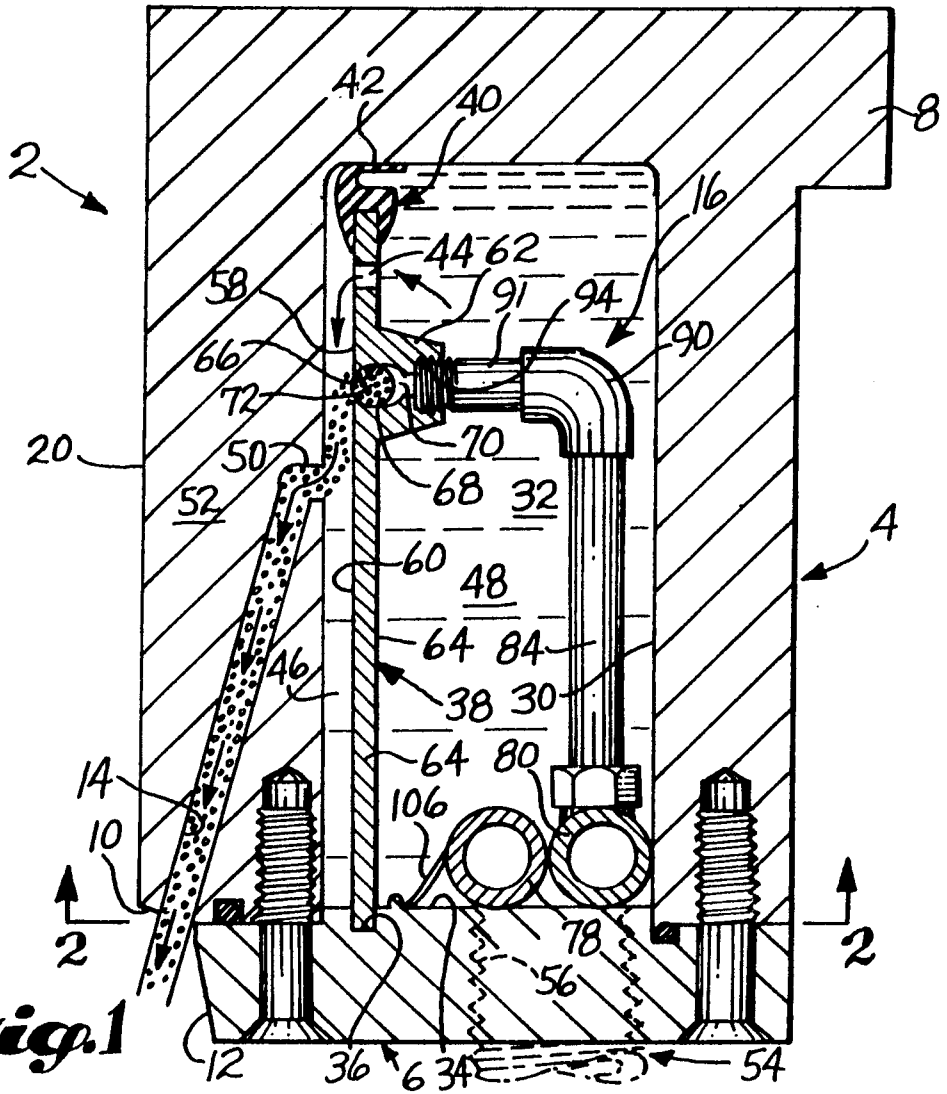
FIG. 1 is a part axial cross section of one embodiment of the mold.
Figure 3:
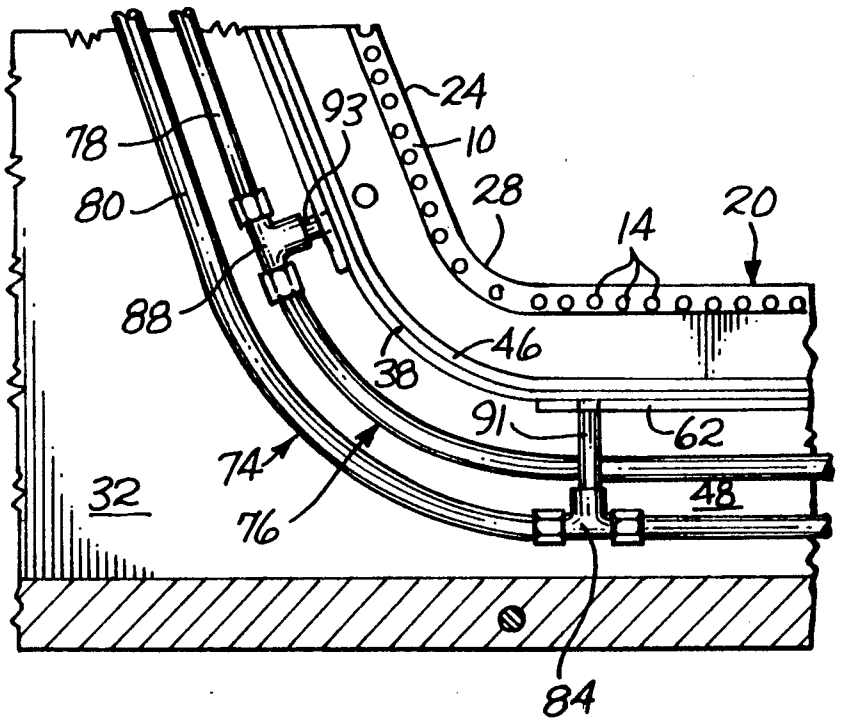
FIG. 3 is an enlarged bottom plan view of the mold at one corner thereof.
Figure 2:
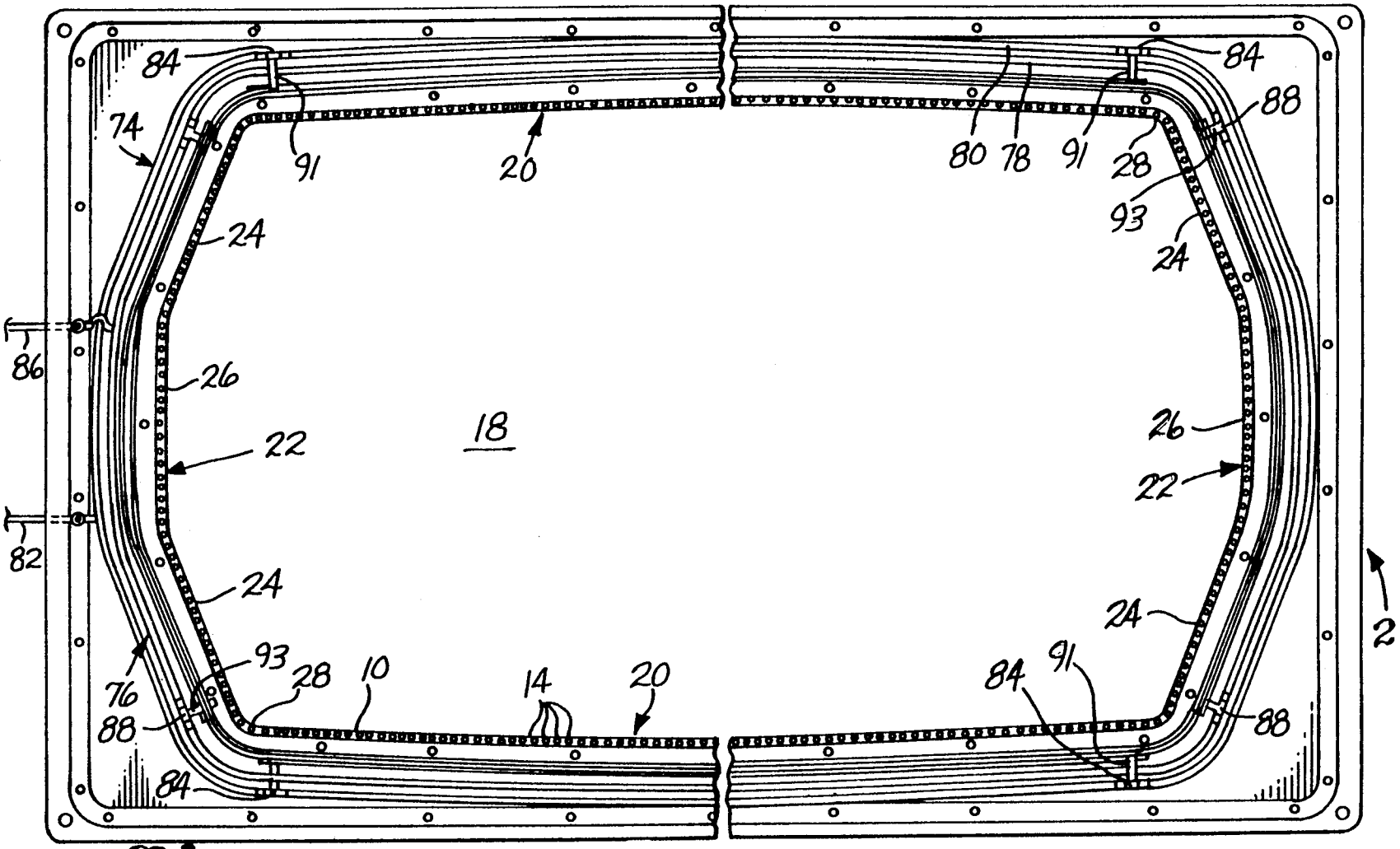
FIG. 2 is a plan view of the mold from the bottom upward along the line 2—2 of FIG. 1.

Referring first to the embodiment shown in FIGS. 1-3, it will be seen that the mold 2 has a generally 5 rectangular outline, inside and out, and is constructed from a pair of annular parts 4 and 6 that are of similar outline. The relatively upper part 4 constitutes the case of the mold and has a substantial body with a mounting flange 8 at the top thereof, and a chamfered inner peripheral edge 10 at the bottom thereof. The relatively lower part 6 is more plate-like and constitutes a cover for the bottom of the case, as well as a skirt 12 for a gallery of closely spaced holes 14 that open into the bottom edge 10 of the case 4 for the discharge of liquid coolant onto the ingot (not shown), as shall be explained. The mold 2 also has several additional components and fittings, including ones providing a gas infusion means 16 for the coolant, as shall also be explained.

More specifically, the case 4 has an open ended rectangular bore 18 which is slightly convexly bowed at the longer sides 20 thereof, and still more convexly bowed at the ends 22 thereof which have three wall sections 24, 26 apiece, the relatively remote of which, 24, are mitered to the corners 28 of the bore, and the intermediate of which, 26, are relatively parallel to one another from one end 22 to the other. The case 4 also has a deeply recessed groove 30 in the underside thereof, which extends about the full circumference of the case and is wide enough to form a chamber 32 within which to retain liquid coolant for discharge through the holes 14 in the bottom edge 10 of the case. The chamber 32 is covered in turn by the plate 6 which is rabbeted at the inner and outer peripheral edges thereof to leave an annular land 34 thereon which fits within the mouth of the chamber 32 when the plate is capscrewed to the underside of the case as shown. The land 34 in turn has a narrow groove 36 therein which extends about the full circumference of the mold at a short distance from the inner peripheral rabbet of the plate, radially outwardly thereof, and holds the bottom of a baffle 38 that is inserted upright in the chamber 32 when the plate 6 is secured to the underside of the case. The baffle is engaged in the groove 36 and welded to the plate, and has an elastomeric gland 40 at the top thereof which has a deformable lip 42 thereon that forms a seal with the top of the chamber 32 when the baffle is mounted on the land and inserted in the chamber. The baffle 38 also has a series of holes 44 in the top thereof which interconnect the relatively inner and outer peripheral portions 46 and 48 of the chamber when it is subdivided by the baffle. The inner peripheral portion 46 is far narrower and opposed by a groove 50 in the inner peripheral wall 52 of the case, which extends about the full circumference of the wall 52 at a midlevel thereof. The gallery of holes 14 is also formed in that wall 52, at perpendiculars to the chamfered edge 10 of the case, and on lines intersecting the groove 50 so that the narrower inner peripheral portion 46 of the chamber communicates with the holes 14 at the groove 50. The holes 14 are also obliquely angled to the bore 18 of the case so that the liquid coolant discharges onto the surface of the emerging ingot in a manner designed to direct cool the ingot in conventional fashion.

The coolant is charged into the outer peripheral portion 48 of the chamber 32 through a set of pipe fittings 54 that are threadedly engaged in a corresponding set of holes 56 in the corners of the plate 6 where the chamber 32 is widest. Once in the outer peripheral portion of the chamber, the coolant then flows into the inner peripheral portion 46 of the same through the holes 44 in the top of the baffle. The latter holes 44 meter the flow and are disposed at a level above the groove 50 in the inner peripheral wall 52 of the case, so that the coolant must flow downward from the holes 44 along parallels to that intermediate portion 58 of the inner peripheral surface 60 of the baffle between the holes 44 and the groove 50. This exposes the coolant to the gas infusion means 16, which not only infuse the coolant with bubbles as in the earlier application, but moreover, with finer bubbles so that the infusion process can be carried out ahead of the holes 14 in the wall 52, as shall now be explained.

As best seen in FIGS. 2 and 3, those portions of the baffle 38 which oppose the sides 20 and end walls 24, 26 of the bore 18, have circumferentially extending ribs 62 outstanding on the outer peripheral surfaces 64 thereof at the level of the intermediate portion 58 of the inner peripheral surface 60 of the baffle. Moreover, at the latter portion 58 of the inner peripheral surface 60, the baffle has corresponding circumferentially extending grooves 66 in the ribs, the axial cross sections of which are radially elliptical or prolate so as to leave the grooves 66 with part spherical mouths 68 that have part elliptical channels 70 recessed therewithin. Part circumferential segments 72 of an O-ring are seated in the mouths 68 of the grooves 66, substantially flush with the intermediate portion 58 of the surface 60 of the baffle, but spaced apart from the bottoms of the grooves 66 by the channels 70 therewithin. The O-ring material is a sintered plastic particle material, such as a polyolefin material, and as such, the segments 72 are porous and gas-permeable, though solid. The channels 70, meanwhile, are open along the lengths of the grooves 66, so that a gas can be forced through the respective segments to discharge as bubbles from the intermediate portion 58 of the surface 60 of the baffle when the coolant is flowing through the inner peripheral portion 46 of the chamber.

The gas is supplied to the respective channels 70 by a pair of pipe systems 74, 76 that are mounted on the plate 6 to accompany the baffle 38 when it is inserted into the chamber 32. The systems 74, 76 comprise a pair of pipe loops 78 and 80 that are concentrically mounted on the land 34 of the plate to occupy the outer peripheral portion 48 of the chamber 32 when the plate is secured to the case. One loop 80 is fed by an inlet pipe 82 at one end of the case, and has pairs of risers 84 teed therewithin which upstand opposite the ribs 62 on the longer sides of the baffle, near the relatively remote ends thereof. The other loop 78 is fed by an inlet pipe 86 at the same end of the case, and has pairs of risers 88 teed therewithin that upstand opposite the ribs 62 on the ends of the baffle, and again near the relatively remote ends thereof. The risers 84 and 88 are outfitted with elbows 90 and 93, respectively, and the elbows 90 in turn with nipples 91, so that the respective fittings 90, 91 and 93 pipe fit to corresponding pairs of pipe threaded holes 94 that are countersunk in the end portions of the corresponding ribs 62, and communicate in turn with the channels 70 of the ribs to supply the same with gas.

In use, the outer peripheral portion 48 of the chamber 32 serves as a pressurized foyer or vestibule for the inner peripheral portion 46 thereof, and the holes 44 in the baffle serve to control the volume of liquid coolant supplied to the holes 14 in the inner peripheral wall 52 of the mold by virtue of the metering action, i.e., the pressure drop that the coolant experiences in traversing the holes 44. Between them, moreover, the holes 44 and 14, and the respective diameters and numbers thereof, determine the distribution of the coolant at the chamfered edge 10 of the mold, given the pressure needed at the fittings 54 to provide the necessary volume. In addition, with the sets of holes 44 and 14 spaced apart from one another by the intermediate portion 58 of the surface 60 of the baffle, and with the coolant forced to flow at high velocity on parallels to that surface, bubbles can be infused into the flow that are finer in size than those that were infused into the flow through the holes 14 themselves in the earlier application. This is to say, the gas charged into the two systems of piping 74, 76 escapes over the whole length of the respective O-ring segments 72, while the coolant itself flows over the exposed surfaces of the segments at higher velocity than the exit velocity it experienced in the holes 14 under the arrangement of the earlier application, and together these factors produce a finer bubble size. Introducing the gas into the chamber 32, rather than into the holes 14, also permits larger volumes of gas to be added without the risk of a blowout in the discharge of the coolant from the exit end of the mold. The introduction of the gas in the chamber also operates to decrease the cooling effect of the liquid coolant in the mold, something that is commonly sought in all direct cooling apparatus.

The improved arrangement is also less expensive to manufacture than the various arrangements disclosed in the earlier application.

The invention is equally applicable to a circumferentially slotted apparatus, and is only illustrated in terms of one with a holed annulus since it has particular advantage in connection with such an apparatus.

Figure 5:
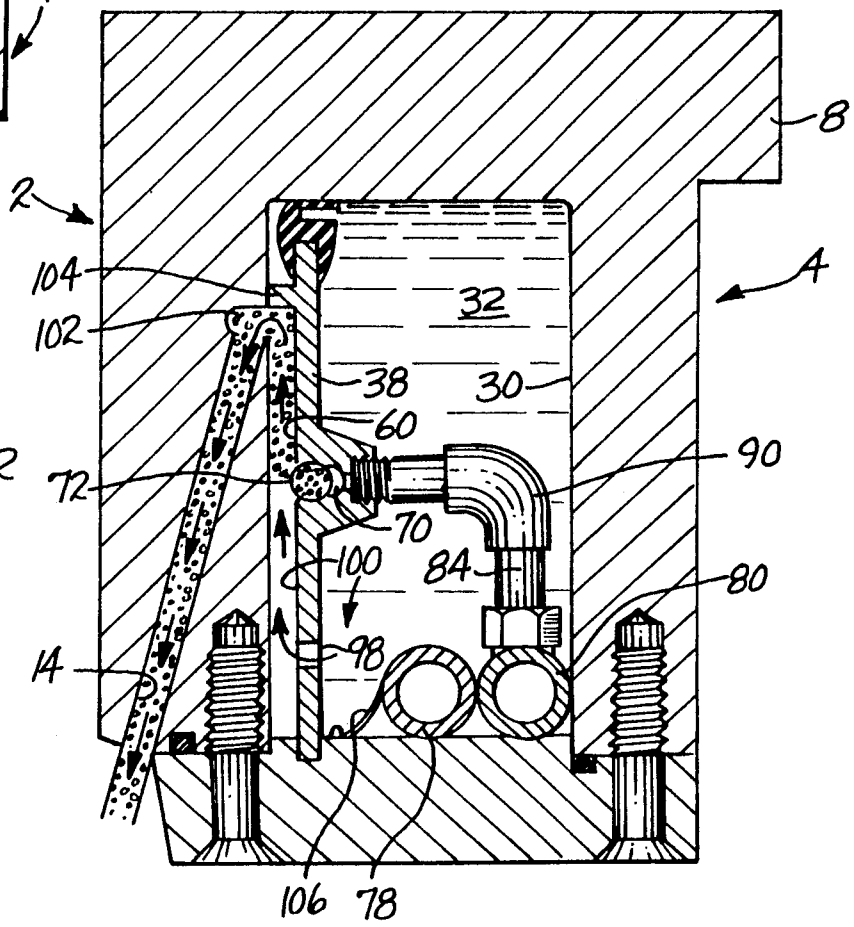
FIG. 5 is a part axial cross section of another embodiment of the mold.
Figure 4:
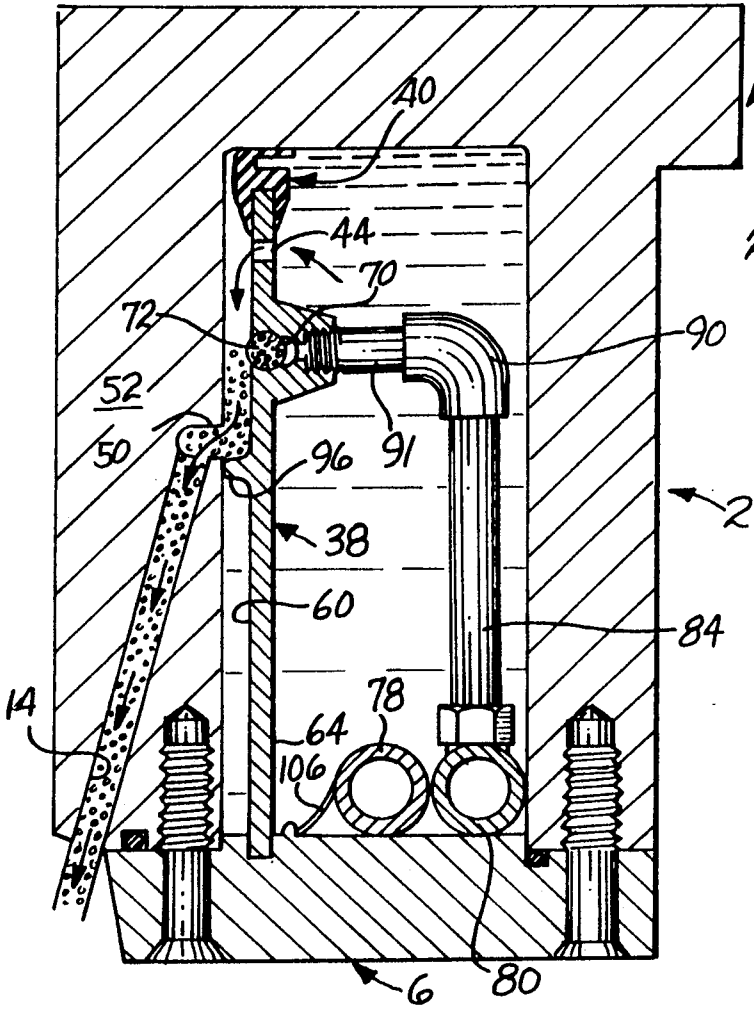
FIG. 4 is a part axial cross section of a modified version of the embodiment shown in FIGS. 1-3.

In the embodiment of FIGS. 1-3, the bottom half of the inner peripheral portion 46 of the chamber 32 is open to the dog-legged flow of coolant between the sets of holes 44 and 14, but since the bottom half of the portion 46 is normally in a stagnate condition, the accumulated coolant in the same operates as a baffling medium for the flow as it reaches the groove 50 in the inner peripheral wall 52 of the mold. Referring now to FIGS. 4 and 5, however, it will be seen that the baffle 38 may also be equipped with a rib 96 on the inner peripheral surface 60 thereof which is adapted to approach or touch the inner peripheral wall 52 of the mold and form a more definite baffling medium with which to assist the flow in negotiating the dog-leg at the groove 50. Furthermore, in FIG. 5, it will be seen that the holes 44 need not be disposed in the top portion of the baffle, but instead, may be disposed at 98 in the bottom portion thereof to provide for up-feed of the coolant across the waist portion 100 of the inner peripheral surface 60 of the baffle, before the coolant reaches a groove 102 in the inner peripheral wall 52 of the mold, more adjacent the top of the baffle. There, the coolant undergoes a reentrant turn in entering the holes 14 descending within the wall, and a rib 104 on the inner peripheral surface 60 of the baffle just above the top of the groove 102, performs a more critical baffling function than in the case of those seen in the embodiments of FIGS. 1-4. The mold is otherwise the same, however, and the effect is also the same from one embodiment to another. It has also been observed that the finely sized bubbles entrained in the coolant flow at the surfaces of the O-ring segments of the present invention, produce a coolant discharge that is in a discontinuous liquid phase laden with bubbles of undissolved gas that will alter the heat transfer characteristics of the coolant on the surface of the ingot, to vary the rate at which heat is lost therefrom, in the same manner as was disclosed in the earlier application.

Due to the pressure differential across the baffle 38 from one chamber portion to the other, the gland 40 is under compression at the deformable lip 42 thereof, and no further means is needed to separate the two portions of the chamber from one another.

Clips 106 are commonly used to clamp the pipe loops 78 and 80 to the land 34.

The baffle 38 is commonly a metal strip, say of aluminum, with extrusions as the ribs 62, 96 and 104.

We claim:

1. In the process of direct cooling a body of partially solidified metal emerging as ingot from the exit end of an open ended mold by the steps of charging liquid coolant into an annular retention chamber which is circumposed about the exit end opening of the mold in the body thereof, and then discharging the chamber coolant onto the surface of the ingot through a first passage opening into the exit end of the mold and communicating with the chamber at an opening therein, the further steps of:

forming a second passage in the chamber which is serially interconnected with the first passage at the chamber opening and operable to deliver the chamber coolant to the first passage at an increased rate of flow, relative to the rate at which the coolant was charged into the chamber, incorporating a body of solid but porous, gas-permeable material into the wall of the second passage at a surface thereof which extends generally parallel to the flow of coolant in the second passage, and forcing pressurized gas through the body of porous, gas-permeable material at a pressure which is less than that which is needed to dissolve the gas in the coolant, so that the chamber coolant discharges through the first passage in a discontinuous liquid phase in which it is laden with bubbles of undissolved gas that will alter the heat transfer characteristics of the coolant on the surface of the ingot to vary the rate at which heat is lost therefrom.

2. The process according to claim 1 wherein the respective passages define flow paths that extend generally parallel to that axis of the mold extending between the end openings thereof.

3. The process according to claim 2 wherein the first passage communicates with the chamber at an opening in the inner peripheral wall thereof, the flow paths of the respective passages are disposed on opposite sides of the chamber opening, and the flow in the same is directed unidirectionally of the mold axis, but undergoes a dog-leg at the chamber opening.

4. The process according to claim 3 further comprising forming a baffling medium on the downstream side of the chamber opening to aid the coolant in traversing the dog-leg.

5. The process according to claim 2 wherein the first passage communicates with the chamber at an opening in the inner peripheral wall thereof, the flow paths of the respective passages are disposed on the same side of the chamber opening, and the flow in the same is directed in the opposing directions of the mold axis, but undergoes a reentrant turn at the chamber opening.

6. The process according to claim 5 further comprising forming a baffling medium on the downstream side of the chamber opening to aid the coolant in traversing the reentrant turn.

7. The process according to claim 1 wherein the second passage is formed by installing a baffle in the chamber to subdivide the chamber into two portions, one of which is serially interconnected with and between the remaining portion and the first passage at an opening defined by the baffle, and the chamber opening, respectively.

8. The process according to claim 7 wherein the baffle is annular and installed in the chamber so as to subdivide the chamber into relatively inner and outer peripheral portions, the coolant is charged into the outer peripheral portion of the chamber, and the first passage communicates with the chamber at an opening in the inner peripheral portion thereof.

9. The process according to claim 8 wherein the opening defined by the baffle is spaced apart from the chamber opening lengthwise of that axis of the mold extending between the end openings thereof, and the inner peripheral portion of the chamber is reduced in width relative to the outer peripheral portion thereof, radially of the axis, so that the chamber coolant is delivered to the first passage at an increased rate of flow, relative to the rate at which the coolant was charged into the outer peripheral portion of the chamber.

10. The process according to claim 9 wherein the body of porous, gas-permeable material is substantially annular and incorporated into the inner peripheral wall of the baffle at that surface of the baffle wall which extends between the chamber opening and the opening defined by the baffle.

11. The process according to claim 10 wherein the first passage communicates with the chamber at an opening in the inner peripheral wall thereof, the baffle has an opening in the body thereof, and the body of porous, gas-permeable material is recessed in a groove substantially circumscribed about the inner peripheral portion of the chamber in the inner peripheral wall of the baffle at that surface of the baffle wall extending between the respective openings of the baffle and the inner peripheral wall of the chamber.

12. The process according to claim 11 wherein the baffle is also equipped with an annular rib on the downstream side of the opening in the inner peripheral wall of the chamber to aid the coolant in traversing the chamber opening.

13. The process according to claim 1 wherein the first passage takes the form of a series of spaced holes that are arrayed in an annulus about the exit end opening of the mold.

14. The process according to claim 13 wherein the holes communicate with the chamber at a circumferential groove in the inner peripheral wall of the chamber.

15. The process according to claim 1 wherein the porous, gas-permeable material is a sintered particle material.

16. The process according to claim 15 wherein the sintered particle material comprises sintered plastic particles.

17. In the process of constructing an open ended mold from which a body of partially solidified metal can be operatively withdrawn as ingot from the exit end of the mold, and within which liquid coolant can be charged into an annular retention chamber circumposed about the exit end opening of the mold, and then discharged onto the surface of the ingot through a first passage opening into the exit end of the mold and communicating with the chamber at an opening therein, the steps of:

installing means in the chamber to form a second passage therein which is serially interconnected with the first passage at the chamber opening and will be operable to deliver the chamber coolant to the first passage at an increased rate of flow, relative to the rate at which coolant will be charged into the chamber, incorporating a body of solid but porous, gas-permeable material into the wall of the second passage at a surface thereof which will extend generally parallel to the flow of coolant in the second passage, and providing means for forcing pressurized gas through the body of porous, gas-permeable material in such way that the chamber coolant will discharge through the first passage in a discontinuous liquid phase in which it is laden with bubbles of undissolved gas that will alter the heat transfer characteristics of the coolant on the surface of the ingot to vary the rate at which heat is lost therefrom.

18. The process according to claim 17 wherein the passage forming means include a baffle which is installed in the chamber to subdivide the chamber into two portions, one of which is serially interconnected with and between the remaining portion and the first passage at an opening defined by the baffle, and the chamber opening, respectively.

19. The process according to claim 18 wherein the baffle is annular and installed in the chamber to subdivide the chamber into relatively inner and outer peripheral portions, and wherein the coolant is operatively charged into the relatively outer peripheral portion of the chamber, and the first passage communicates with the chamber at an opening in the inner peripheral portion thereof.

20. The process according to claim 19 wherein the body of porous, gas-permeable material is substantially annular and incorporated into the inner peripheral wall of the baffle.

21. The process according to claim 20 wherein the means for forcing pressurized gas through the body of porous material are connected to the outer peripheral wall of the baffle opposite the body of porous material.

22. The process according to claim 19 wherein the mold comprises an annular case having an annular groove in the exit end thereof, and the baffle is installed in the chamber by securing an annular plate to the exit end of the case which covers the groove to form the chamber, and has the baffle relatively upstanding thereon to subdivide the chamber into relatively inner and outer peripheral portions.

23. The process according to claim 22 wherein the first passage communicates with the chamber at an opening in the inner peripheral wall thereof, the baffle has an opening in the body thereof which is operatively spaced apart from the chamber opening lengthwise of that axis of the mold extending between the end openings thereof, the body of porous, gas-permeable material is substantially annular and incorporated in the inner peripheral wall of the baffle at that surface of the baffle wall operatively disposed to extend between the chamber opening and the opening in the baffle, and the means for forcing pressurized gas through the body of porous material are supported on the plate to occupy the outer peripheral portion of the chamber in connection with the outer peripheral wall of the baffle at an inlet opposite the body of porous material.

24. The process according to claim 23 wherein the body of porous material is recessed in a groove operatively substantially circumscribed about the inner peripheral portion of the chamber in the inner peripheral wall of the baffle, and the gas pressurization means are interconnected with a channel that is circumscribed about the body of porous material at the bottom of the groove in the baffle to supply the gas to the same throughout the circumference of the body of porous material.

25. The process according to claim 24 wherein the gas pressurization means include a system of piping which is supported on the plate and installed in the outer peripheral portion of the chamber when the plate is secured to the case, to feed the gas to the channel through a set of inlets on the outer peripheral wall of the baffle opposite the channel.

26. In an open ended mold from which a body of partially solidified metal can be operatively withdrawn as ingot from the exit end of the mold, and within which liquid coolant can be charged into an annular retention chamber circumposed about the exit end opening of the mold, and then discharged onto the surface of the ingot through a first passage opening into the exit end of the mold and communicating with the chamber at an opening therein, the improvement comprising:

means for forming a second passage in the chamber which is serially interconnected with the first passage at the chamber opening and operable to deliver the chamber coolant to the first passage at an increased rate of flow, relative to the rate of flow at which the coolant was charged into the chamber, a body of solid but porous, gas-permeable material incorporated into the wall of the second passage at a surface thereof which extends generally parallel to the flow of coolant in the second passage, and means for forcing pressurized gas through the body of porous, gas-permeable material in such a way that the chamber coolant discharges through the first passage in a discontinuous liquid phase in which it is laden with bubbles of undissolved gas that will alter the heat transfer characteristics of the coolant on the surface of the ingot to vary the rate at which heat is lost therefrom.

27. The open ended mold according to claim 26 wherein the respective passages define flow paths that extend generally parallel to that axis of the mold extending between the end openings thereof.

28. The open ended mold according to claim 27 wherein the first passage communicates with the chamber at an opening in the inner peripheral wall thereof, the flow paths of the respective passages are disposed on opposite sides of the chamber opening, and the flow in the same is directed unidirectionally of the mold axis, but undergoes a dog-leg at the chamber opening.

29. The open ended mold according to claim 28 further comprising means forming a baffling medium on the downstream side of the chamber opening to aid the coolant in traversing the dog-leg.

30. The open ended mold according to claim 27 wherein the first passage communicates with the chamber at an opening in the inner peripheral wall thereof, the flow paths of the respective passages are disposed on the same side of the chamber opening, and the flow in the same is directed in the opposing directions of the mold axis, but undergoes a reentrant turn at the chamber opening.

31. The open ended mold according to claim 30 further comprising means forming a baffling medium on the downstream side of the chamber opening to aid the coolant in traversing the reentrant turn.

32. The open ended mold according to claim 26 wherein the passage forming means include a baffle that is installed in the chamber to subdivide the chamber into two portions, one of which is serially interconnected with and between the remaining portion and the first passage at an opening defined by the baffle, and the chamber opening, respectively.

33. The open ended mold according to claim 32 wherein the baffle is annular and installed in the chamber so as to subdivide the chamber into relatively inner and outer peripheral portions, the coolant is operatively charged into the outer peripheral portion of the chamber, and the first passage communicates with the chamber at an opening in the inner peripheral portion thereof.

34. The open ended mold according to claim 33 wherein the opening defined by the baffle is spaced apart from the chamber opening lengthwise of that axis of the mold extending between the end openings thereof, and the inner peripheral portion of the chamber is reduced in width relative to the outer peripheral portion thereof, radially of the axis, so that the chamber coolant is operatively delivered to the first passage in the inner peripheral portion, at an increased rate of flow relative to the rate at which the coolant was charged into the outer peripheral portion of the chamber.

35. The open ended mold according to claim 34 wherein the body of porous, gas-permeable material is substantially annular and incorporated into the inner peripheral wall of the baffle at that surface of the baffle wall which extends between the chamber opening and the opening defined by the baffle.

36. The open ended mold according to claim 35 wherein the first passage communicates with the chamber at an opening in the inner peripheral wall thereof, the baffle has an opening in the body thereof, and the body of porous, gas-permeable material is recessed in a groove substantially circumscribed about the inner peripheral portion of the chamber in the inner peripheral wall of the baffle at that surface of the baffle wall extending between the respective openings in the baffle and the inner peripheral wall of the chamber.

37. The open ended mold according to claim 36 wherein the baffle also has an annular lip on the downstream side of the opening in the inner peripheral wall of the chamber, to aid the coolant in traversing the chamber opening.

38. The open ended mold according to claim 26 wherein the first passage takes the form of a series of spaced holes which are arrayed in an annulus about the exit end opening of the mold.

39. The open ended mold according to claim 38 wherein the holes communicate with the chamber at a circumferential groove in the inner peripheral wall of the chamber.

40. The open ended mold according to claim 26 wherein the porous, gas-permeable material is a sintered particle material.

41. The open ended mold according to claim 40 wherein the sintered particle material comprises sintered plastic particles.

42. The open ended mold according to claim 26 wherein the body of the mold comprises an annular case having an annular groove in the exit end thereof, an annular plate which is secured to the exit end of the case to cover the groove and form the chamber, and an annular baffle which is relatively upstanding on the plate so as to subdivide the chamber into relatively inner and outer peripheral portions, the relatively inner peripheral portion of which is serially interconnected with and between the relatively outer peripheral portion of the chamber and the first passage at an opening defined by the baffle, and the chamber opening, respectively.

43. The open ended mold according to claim 42 wherein the first passage communicates with the chamber at an opening in the inner peripheral wall thereof, the baffle has an opening in the body thereof which is spaced apart from the chamber opening lengthwise of that axis of the mold extending between the end openings thereof, the body of porous, gas-permeable material is substantially annular and incorporated into the inner peripheral wall of the baffle at that surface of the baffle wall extending between the chamber opening and the opening in the baffle, and the means for forcing pressurized gas through the body of porous material are disposed in the outer peripheral portion of the chamber and connected with the outer peripheral wall of the baffle at an inlet opposed to the body of porous material.

44. The open ended mold according to claim 43 wherein the body of porous material is recessed in a groove substantially circumscribed about the inner peripheral portion of the chamber in the inner peripheral wall of the baffle, and the gas pressurization means are interconnected with a channel that is circumscribed about the body of porous material at the bottom of the groove in the baffle to supply the gas to the channel throughout the circumference of the body of porous material.

45. The open ended mold according to claim 44 wherein the gas pressurization means include a system of piping which is supported on the plate in the outer peripheral portion of the chamber.

46. A component with which to subdivide into relatively inner and outer peripheral portions, an annular coolant retention chamber that is circumposed about the exit end opening of an open ended ingot casting mold in the body thereof, so that when coolant is charged into the chamber, the coolant can be discharged onto the surface of the ingot emerging from the exit end of the mold, with bubbles of gas infused therein, comprising:

an annular baffle insertable in the chamber to subdivide the same into the aforesaid portions, a substantially annular body of solid but porous, gas-permeable material incorporated into the inner peripheral wall of the baffle at the surface thereof, and means including a channel circumscribed about the body of porous material between the inner and outer peripheral walls of the baffle, whereby pressurized gas can be forced through the body of porous material to infuse the coolant with bubbles of the same in the inner peripheral portion of the chamber.

47. The construction component according to claim 46 wherein the porous, qas-permeable material is a sintered particle material.

48. The construction component according to claim 47 wherein the sintered particle material comprises sintered plastic particles.

49. The construction component according to claim 46 wherein the body of porous material is recessed in a groove substantially circumscribed about the inner periphery of the baffle in the inner peripheral wall thereof, and having the channel at the bottom thereof to supply the gas to the body of porous material throughout the circumference thereof.

50. The construction component according to claim 46 wherein the baffle has an opening therein for the discharge of the chamber coolant into the inner peripheral portion of the chamber from the outer peripheral portion thereof when the coolant is charged into the latter portion of the chamber.

51. The construction component according to claim 50 wherein the baffle also has an annular rib on the inner peripheral wall thereof, which is spaced apart from the opening in the baffle on the opposite side of the body of porous material in directions parallel to that axis of the baffle extending between the end openings thereof.

52. The construction component according to claim 46 wherein the annular baffle is relatively upstanding on an annular plate that is adapted to be secured to the exit end of an annular case having an annular groove in the exit end thereof, to cover the groove and form the chamber when the baffle is inserted in the groove to subdivide the chamber.

53. The construction component according to claim 52 wherein the means for forcing gas through the body of porous, gas-permeable material also include a system of gas supply piping which is supported on the plate for insertion in the outer peripheral portion of the chamber in connection with an inlet opposite the channel in the baffle.

* * * * *